United States Patent [19]

Watanabe

[11] Patent Number: 4,809,407

[45] Date of Patent: Mar. 7, 1989

[54] OPEN-FACED BUTTONS

[75] Inventor: Hirokazu Watanabe, Kurobe, Japan

[73] Assignee: Yoshida Kogyo K. K., Tokyo, Japan

[21] Appl. No.: 131,638

[22] Filed: Dec. 11, 1987

[30] Foreign Application Priority Data

Dec. 12, 1986 [JP] Japan ..... 61-191511

[51] Int. Cl.[4] ..... A44B 1/42

[52] U.S. Cl. ..... 24/95; 24/113 MP

[58] Field of Search ..... 24/95, 94, 90 R, 621, 24/691, 113 R, 113 MP, 90 A, 96; 40/315

[56] References Cited

U.S. PATENT DOCUMENTS

| | | | |
|---|---|---|---|
| 32,087 | 4/1861 | Smith | 24/90 R |
| 559,919 | 5/1896 | White et al. | 24/95 |
| 598,022 | 1/1898 | Shipley et al. | 24/95 |
| 1,518,718 | 12/1924 | White | 24/90 R |
| 1,635,774 | 7/1927 | Abel | 24/95 |
| 1,851,618 | 3/1932 | Cowdrey | 24/90 A |
| 4,295,230 | 6/1890 | Jackson et al. | 24/113 R |

FOREIGN PATENT DOCUMENTS

| | | | |
|---|---|---|---|
| 850869 | 9/1970 | Canada | 24/90 R |

*Primary Examiner*—Kenneth J. Dorner
*Assistant Examiner*—James R. Brittain

[57] ABSTRACT

A button body of an open-faced button includes an ornamental face disk rotatably supported on a cylindrical retainer firmly fitted in the tubular stem of a button back. The retainer has an axial hole for receiving the shank of a tack, and a radial groove extending transversely across the axial hole. The radial groove and the axial hole is separated by a locking step extending perpendicular to the longitudinal axis of the retainer. When the shank is staked into the retainer to attach the button body to a garment fabric, a front end of the shank is deformed into an axially compressed and radially swelled end portion and held in interlocking engagement with the locking step of the retainer.

9 Claims, 3 Drawing Sheets

OPEN-FACED BUTTONS

BACKGROUND OF THE INVENTION

1. Field of the Invention

The present invention relates to tack buttons for attachment to garment fabrics, and more particularly to an open-faced button having a retainer disposed in a button body for rotatably holding an ornamental face disk of the button body.

2. Prior Art

A known tack button of the type described includes a retainer firmly fitted in a button body for rotatably retaining an ornamental face disk of the button body. The retainer has a central blind hole and a radial shoulder projecting into the hole to retain thereon an axially compressed, radially swelled end portion of the shank of a tack when the shank is staked into the central blind hole for attaching the button body to a garment fabric. The retainer is generally molded by die-casting, and hence require a notched movable core for the formation of the shouldered blind hole of a molded retainer. In the manufacture of the molded retainer, the shoulder is necessarily scarred or otherwise damaged when the movable core is forcibly removed from the blind hole. Such damage on the shoulder may be partly reduced when the shoulder is tapered to such an extent that the movable core is removed from the blind hole without undue resistance. The tapered shoulder however is not satisfactory in that the swelled end portion of the staked shank may be accidentally snapped off from the retainer, resulting in detachment of the tack member from the button body.

SUMMARY OF THE INVENTION

It is accordingly an object of the present invention to provide an open-faced button having a tack-retainer incorporating structural features which enable firm coupling of a button body and a mating tack when the tack is staked in the button body.

According to the present invention, an open-faced button includes a button body composed of a button back of an inverted hat-like shape, a cylindrical retainer firmly fitted in a tubular stem of the button back, and an annular ornamental face disk rotatably supported on the retainer and overlying a flange of the button back. The retainer has an axial hole for receiving the shank of a tack, and a radial groove extending transversely across the axial hole and separated from the axial hole by a locking step. The locking step preferably extends perpendicular to the longitudinal axis of the retainer. When the shank is staked into the retainer, the locking step is brought into interlocking engagement with a deformed front end of the shank, thereby firmly locking the shank in position against removal from the button body.

Many other advantages and features of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE DRAWINGS

FIG. 5 is a cross-sectional view of a mold assembly used for producing a retainer of the button body shown in

DETAILED DESCRIPTION

Figure 1:
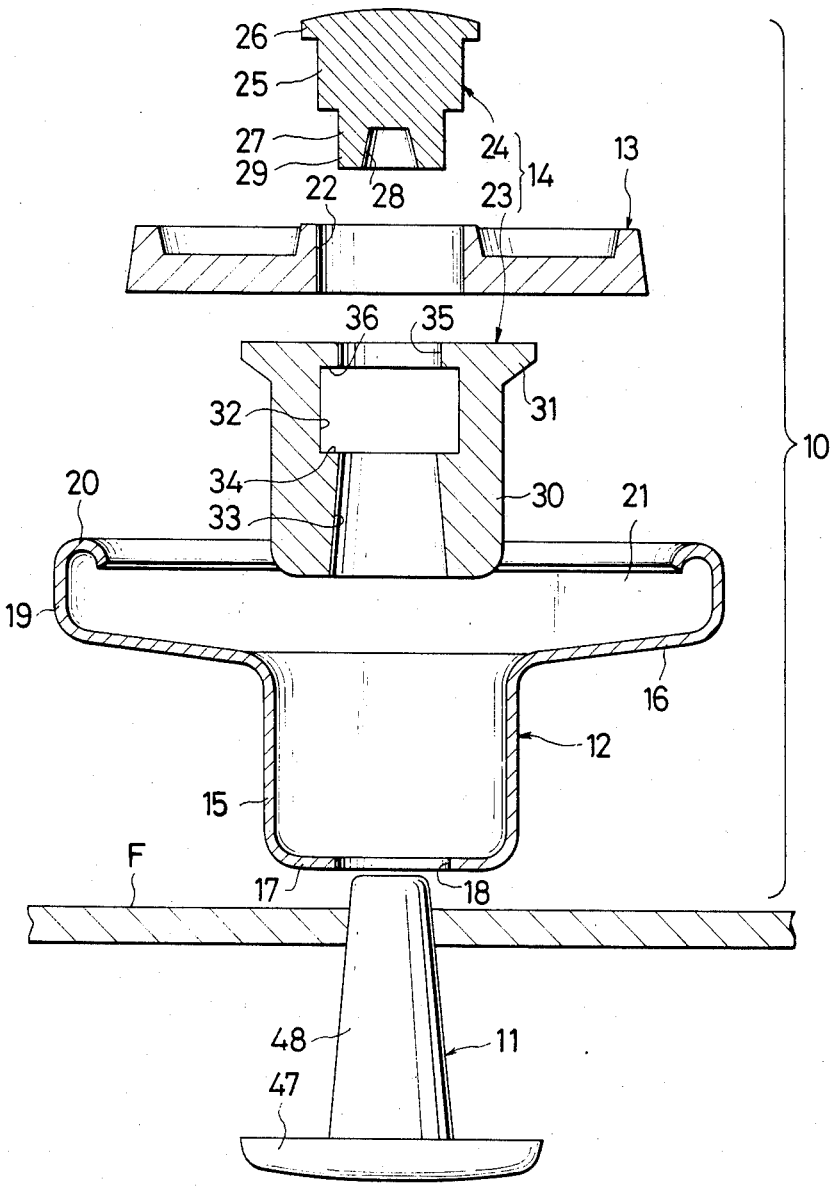
FIG. 1 is an exploded cross-sectional view of an embodiment of open-faced button according to the present invention.

As shown in FIG. 1, an open-faced button embodying the present invention is composed of a button body 10 and a tack 11 to be assembled together to attach the button to a garment fabric F.

The button body 10 comprises a button back 12, an ornamental face disk 13 overlying the front face of the button back 12, and a retainer 14 disposed in the button back 12 for rotatably retaining the face disk 13.

The button back 12 has a generally inverted-hat shape and includes a tubular stem 15 having an integral annular flange 16 extending radially outwardly from an upper end of the tubular stem 15. The stem 15 has a flat bottom 17 extending radially inwardly from the lower end of the stem 15 to define a central opening 18. The annular flange 16 has an outer peripheral portion 19 bent upwardly in a direction parallel to the axis of the stem 15 and terminating in an inwardly curled edge 20. The flange 16 thus shaped defines a recess 21 for receiving therein the ornamental face disk 13.

The face disk 13 has an annular shape and includes a central hole 22. Although not shown, the face disk 13 usually has a character, mark or design provided on its front face for ornamental purposes.

The retainer 14 is composed of a hollow cylinder 23 and a pin or rivet 24. The pin 24 has a cylindrical shank 25 slidably receivable in the hole 22 in the face disk 13, an enlarged head 26 on an upper end of the shank 25 engageable with an end face of the face disk 13, and an axial end extension 27 of a reduced diameter extending from a lower end of the shank 25. The end extension 27 has a downwardly open central recess 28 and a forgeable annular strip 29 extending around the recess 28. The shank 25 has a length slightly larger than the thickness of the face disk 13 so that the face disk 13 is rotatable about the pin 24 when the pin 24 is clinched with the cylinder 23 with the face disk 13 disposed therebetween.

The cylinder 23 includes a body 30 having an upper flange 31 for supporting thereon the face disk 13. The cylinder 23 has a rectangular radial groove 32 extending diametrically therethrough, and a lower axial hole 33 extending upwardly from the lower end of the cylinder 23 and blending into the radial groove 32. The axial hole 33 is tapering upwardly toward the radial groove 32 and has a diameter smaller than the width of the radial groove 32. The radial groove 32 and the axial hole 33 is separated by an annular locking step 34 extending perpendicular to the axis of the cylinder 23. The cylinder 23 also has an upper axial hole 35 extending downwardly from the upper end thereof in concentric relation to the lower axial hole 33 and blending into the radial groove 32. The upper hole 35 has a diameter substantially the same as or slightly smaller than the diameter of the small-diameter end extension 27 of the pin 24. The diameter of the upper axial hole 35 is smaller than the width of the radial groove 32 so that the upper axial hole 35 and the radial groove 32 are separated by an annular locking shoulder 36 extending perpendicular to the axis of the cylinder 23. The radial groove 32 may be closed at one end on condition that the locking step 34 and the locking shoulder 36 are formed around inner ends of the lower and upper axial holes 33, 35.

Figure 3:
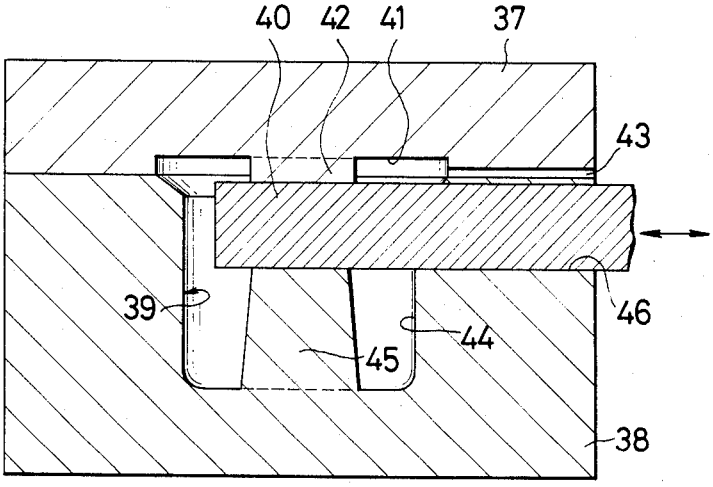
FIG. 3 is a cross-sectional view of a mold assembly used for producing a retainer member of the button shown in FIG. 1.

The cylinder 23 is molded by die-casting a molten metal into a mold assembly as shown in FIG. 3. The mold assembly is composed of a stationary first mold member 37, a movable second mold member 38 reciprocably movable toward the first mold member 37 to close a mold cavity 39 defined between the first and second mold members 37, 38, and an elongate movable core 40 slidably mounted in the second mold member 38 and movable into and out of the mold cavity 39 in a direction perpendicular to the direction of movement of the second mold member 38 for forming the radial groove 32 in a molded cylinder 23.

The first mold member 37 serves to form an upper portion of the cylinder 23 and has an annluar recess 41 complementary in contour to the upper portion of the cylinder 23, a cylindrical projection 42 disposed centrally in the recess 41 for forming the upper axial hole 35 in the cylinder 23, and a gate 43 extending in a front face of the first mold member 37 for the passage of a molten metal to be injected into the mold cavity 39.

The second mold member 38 has an annular recess 44 complementary in contour to a lower portion of the cylinder 23 except the radial groove 32, a tapered cylindrical projection 45 disposed centrally in the recess 44 for forming the lower axial hole 33 in the cylinder 23, and a guide groove 46 extending radially outwardly from the recess 44 for receiving the movable core 40, the annular recess 44 being disposed concentrically with the annular recess 41 in the first mold member 37.

For molding the cylinder 23, the second mold member 38 is advanced toward the first mold member 37 to close the mold cavity 39. In this instance, the core 40 is held in its fully advanced position in which the core 40 diametrically across the annular recess 44 in the second mold member 38. Then a molten metal is injected through the gate 43 into the mold cavity 39 to fill the latter. After a predetermined period of curing time has lapsed, the movable core 40 is retracted from the mold cavity 39. Then the second mold member 38 is retracted away from the first mold member 37. During that time, non-illustrated ejector pins are lifted to remove a molded cylinder (identical with the cylinder 23 shown in FIG. 1) from the second mold member 38. With the use of the movable core 40, the radial groove 32 is formed in the cylinder 23 without damage to the locking step 34 and the locking shoulder 36.

The tack 11 of the button, as shown in FIG. 1, includes a circular head 47 and a tapered cylindrical shank 48 extending perpendicularly from the center of the head 47.

The button body 10 of the foregoing construction is assembled as follows: The pin 24 is disposed on a clinching die (not shown) with its shank 25 directed upwardly. Then the face disk 13 is fitted over the shank 25 until it engages the head 26 of the pin 24. Thereafter, the cylinder 23 is mounted on the shank 25 of the pin 24. In this instance, the end extension 27 of the shank 25 projects through the axial hole 35 into the radial groove 32 in the cylinder 23. Finally, a clinching punch (not shown) is driven through the axial hole 33 into the radial groove 32 to stake the annular strip 29 of the end extension 27 against the locking shoulder 36 of the cylinder 23, thereby assembling the pin 24 and the cylinder 23 in clinched condition with the face disk 13 rotatably disposed therebetween. Since the shoulder 36 extends perpendicular to the axis of the pin 23, the pin 24 is firmly locked in position against detachment from the cylinder 23.

Figure 2:
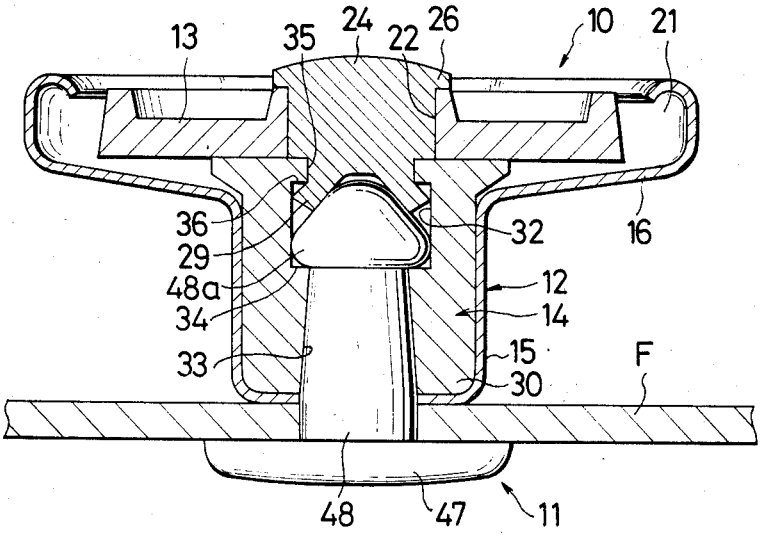
FIG. 2 is a cross-sectional view showing an assembled button.

Then the body 30 of the cylinder 23 is press-fitted in the tubular stem 15 of the button back 12, thereby assembling the retainer 14 with the button back 12, with the face disk 13 rotatably received in the recess 21 in the flange 16, as shown in FIG. 2. For enabling such press-fitting, the outside diameter of the cylinder 30 is slightly larger than the inside diameter of the tubular stem 15. With this press-fitting, the retainer 14 is firmly locked in the button back 12 against displacement.

The button body 10 thus assembled is attached to a garment fabric F by staking the tapered shank 48 of the tack 11 into the retainer 14 through the opening 19 in the button back 12. In this instance, a front end of the shank 48 is deformed into an axially compressed and radially swelled portion 48*a* (FIG. 2) as it is pressed against the lower end of the pin 24. The end portion 48*a* thus deformed is hold in interlocking engagement with the locking step 34 of the retainer 14. Since the locking step 34 extends in a plane normal to the axis of the shank 48, the tack 11 is firmly locked in position against removal from the button body 10.

Figure 4:
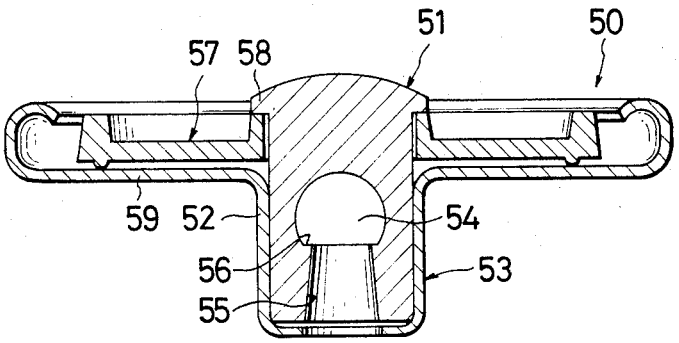
FIG. 4 is a cross-sectional view of a button body according to another embodiment.

A modified button body 50 shown in FIG. 4 is substantially the same as the button body 10 shown in FIG. 2 with the exception that a retainer 51 of this button body 50 is integral or one-piece construction. The button body 50 with such one-piece retainer 51 has a minimum number of structural components and hence can be assembled easily at a low cost.

The retainer 51 is in the form of a headed cylinder having an outside diameter slightly larger than the inside diameter of a tubular stem 52 of a button back 53. The cylindrical retainer 51 has a radial groove 54 extending diametrically therethrough at a central portion of the retainer 51, and an axial hole 55 extending upwardly from a lower end of the retainer 51 and blending into the radial groove 54. The radial groove 54 has a parti-circular cross-sectional shape and is separated from the axial hole 55 by a locking step 56 which extends perpendicular to the longitudinal axis of the axial hole 55. The axial hole 55 is tapered toward the radial groove 54. A face disk 57 of the button body 50 is rotatably mounted on the cylindrical retainer 51 and supported by and between a circular head 58 of the retainer 51 and an annular flange 59 of the button back 53.

Figure 5:
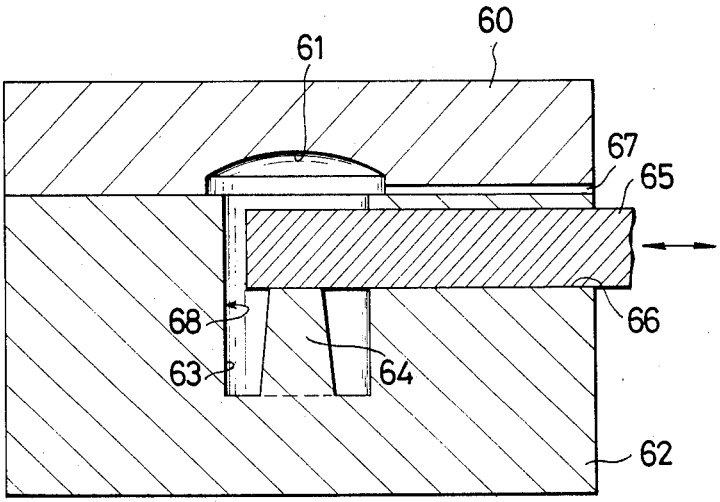

FIG. 5 shows a mold assembly used for forming the retainer 51 of FIG. 4. The mold assembly is composed of a stationary first mold member 60 having a circular recess 61 complementaruy in contour to the head 58 of the retainer 51, a movable second mold member 62 having an annular recess 63 complementary in contour to the body of the retainer 51 and a tapered cylindrical projection 64 disposed centrally in the recess 63 for forming the axial hole 55, and an elongate movable core 65 slidably received in a horizontal guide groove 66 in the second mold member 62 and movable into and out of the recess 63 in a direction perpendicular to the longitudinal axis of the cylindrical projection 64 for forming the radial groove 54 in the retainer 51. To make the retainer 51, a molten metal is injected from a gate 67 into a mold cavity 68 which is formed jointly by the recesses 61, 63 when the mold assembly is being closed.

The molded retainer 51 is press-fitted in the tubular stem 52 of the button back 53 with the face disk 57 rotatably disposed therebetween, thus completing a button body 50. The button body 50 is attached by a tack (identical with the tack 11 shown in FIG. 1) to a garment fabric in the same manner as done with the button body 10 of the foregoing embodiment.

Obviously, various modifications and variations of the present invention are possible in the light of the above teaching. It is therefore to be understood that within the scope of the appended claims the invention may be practiced otherwise than as specifically described.

What is claimed is:

1. An open-faced button comprising:

(a) a button body and a tack adapted to be joined with said button body to attach the latter to a garment fabric;

(b) said button body including (1) a button back having a tubular stem and an annular flange extending radially outwardly from one end of said stem, (2) an annular face disk overlying said annular flange, and (3) a cylindrical retainer firmly fitted in said tubular stem and supporting thereon said face disk; and (c) said cylindrical retainer having a central axial hole having one end disposed adjacent to the other end of said stem for receiving therein a shank of said tack, and a radial groove extending radially inwardly from an outer peripheral surface of said cylindrical retainer toward the central axis of said cylindrical retainer and blending into the other end of said axial hole, said radial groove extending transversely across said axial hole, having a width larger than the diameter of said axial hole and being separated from said axial hole by a locking step, said locking step being interlockingly engageable with an end portion of said shank when said shank is forced into said axial hole.

2. An open-faced button according to claim 1, said locking step extending perpendicular to the longitudinal axis of said axial hole.

3. An open-faced button according to claim 1, said radial groove extending diametrically through said retainer.

4. An open-faced button according to claim 1, said radial groove having a rectangular cross-sectional shape.

5. An open-faced button according to claim 1, said radial groove having a parti-circular cross-sectional shape.

6. An open-faced button according to claim 1, said retainer including a cylinder firmly fitted in said tubular stem, and a pin joined with said cylinder and rotatably supporting thereon said face disk.

7. An open-faced button according to claim 1, said retainer having a one-piece structure.

8. An open-faced button comprising:

(a) a button body and a tack adapted to be joined with said button body to attach the latter to a garment fabric;

(b) said button body including (1) a button back having a tubular stem and an annular flange extending radially outwardly from one end of said stem, (2) an annular face disk overlying said annular flange, and (3) a cylindrical retainer firmly fitted in said tubular stem and supporting thereon said face disk;

(c) said cylindrical retainer having a central axial hole having an open end disposed adjacent to the other end of said stem for receiving therein a shank of said tack, and a radial groove extending transversely across said axial hole, said radial groove extending transversely across said axial hole, having a width larger than the diameter of said axial and being separated from said axial hole by a locking step, said locking step being interlockingly engageable with an end portion of said shank when said shank is forced into said axial hole; and (d) said retainer including a cylinder firmly fitted in said tubular stem, and a pin joined with said cylinder and rotatably supporting thereon said face disk, (e) said radial groove extending in said cylinder, said axial hole extending from one end toward the other end of said cylinder and blending into said radial groove, said cylinder having a further axial hole extending from the other end toward said one end of said cylinder and blending into said radial groove, said further axial hole having a diameter smaller than said width of said radial groove and being separated from said radial groove by a locking shoulder facing said locking step, said pin having one end held in interlocking engagement with said locking shoulder.

9. An open-faced button according to claim 8, said locking step extending perpendicular to the longitudinal axis of said axial hole, said locking shoulder extending parallel to said locking step.

* * * * *